US005226409A

United States Patent [19]

Bower et al.

[11] Patent Number: 5,226,409

[45] Date of Patent: Jul. 13, 1993

[54] PROTECTIVE HOOD WITH ELASTOMERIC NECK SEAL

[75] Inventors: James W. Bower, Ilion, N.Y.; Jerome Hochberg, Wilmington; James K. Odle, Newark, both of Del.

[73] Assignee: E. I. DuPont de Nemours and Company, Wilmington, Del.

[21] Appl. No.: 622,267

[22] Filed: Dec. 5, 1990

Related U.S. Application Data

[63] Continuation-in-part of Ser. No. 481,222, Feb. 20, 1990, Pat. No. 5,065,512, which is a continuation of Ser. No. 363,388, Jun. 6, 1989, abandoned, which is a continuation of Ser. No. 120,533, Nov. 13, 1987, abandoned.

[51] Int. Cl.[5] ..... A62B 17/04

[52] U.S. Cl. ..... 128/201.23; 128/201.25

[58] Field of Search ..... 128/201.23, 201.24, 128/201.25

[56] References Cited

U.S. PATENT DOCUMENTS

| | | | |
|---|---|---|---|
| 622,677 | 4/1989 | Gallagher et al. | 128/201.25 |
| 2,377,122 | 5/1945 | Bakke | 128/201.25 |
| 3,521,629 | 7/1970 | Reynolds | 128/201.23 |
| 4,186,735 | 2/1980 | Henneman et al. | 128/201.25 |
| 4,186,736 | 2/1980 | Angioletti et al. | 128/201.25 |
| 4,523,588 | 6/1985 | Dolsky | 128/201.25 |
| 4,589,408 | 5/1986 | Singer | 128/201.25 |
| 4,627,431 | 12/1986 | Werjefelt | 128/201.25 |
| 4,637,383 | 1/1987 | Lopez | 128/201.25 |
| 4,771,771 | 9/1988 | Walther | 128/201.25 |

*Primary Examiner*—Edgar S. Burr
*Assistant Examiner*—Aaron J. Lewis

[57] ABSTRACT

A hood suitable for protection against decompression and toxic fumes having a flanged neck seal.

7 Claims, 3 Drawing Sheets

PROTECTIVE HOOD WITH ELASTOMERIC NECK SEAL

CROSS-REFERENCE TO RELATED APPLICATIONS

This is a continuation-in-part of application Ser. No. 07/481,222, filed Feb. 20, 1990, now U.S. Pat. No. 5,065,512, which is continuation of application Ser. No. 07/363,388, filed Jun. 6, 1989, now abandoned which is a continuation of application Ser. No. 07/120,533, filed Nov. 13, 1987 now abandoned.

BACKGROUND OF THE INVENTION

Inhalation of smoke and toxic fumes in the event of onboard fire in aircraft is a serious threat to passengers. The oxygen masks provided on airplanes offer protection only for decompression. Similarly, fire in high rise buildings is of great concern, because of the difficulty of escape and exposure to smoke and toxic fumes.

A variety of protective hoods have previously been proposed to alleviate this problem, including those described and claimed in Werjefelt, U.S. Pat. Nos. 4,440,164 and 4,627,431. A preferred material for construction of the Werjefelt hoods is polyimide film, which provides outstanding resistance to heat. However, continuing needs with regard to these hoods include the provision of a neck seal having even greater adaptability and reliability than those previously used.

SUMMARY OF THE INVENTION

The present invention provides a hood of the type suitable for protection against decompression and toxic fumes, having a neck seal which provides improved sealing effectiveness and long term reliability.

Specifically, the instant invention provides, in a protective hood having a generally tubular configuration with a closed top end and a bottom end having a resilient neck seal with an opening which permits at least the head of a user into the hood and forming a closure around the user, the improvement wherein the neck seal comprises an annular ring having an upper and lower surface and a circular opening in the center for the user's head and a flange extending from the opening in a direction substantially perpendicular to the surface of the annular ring.

The seal preferably further comprises a circumferential flange extending in a direction substantially perpendicular from the surface of the annular ring and bonded to the sidewall of the hood.

DETAILED DESCRIPTION OF THE INVENTION

The hoods of the present invention can be constructed in the general configuration and using the techniques described in Werjefelt, U.S. Pat. Nos. 4,440,164 and 4,627,431, hereby incorporated by reference.

Figure 1:
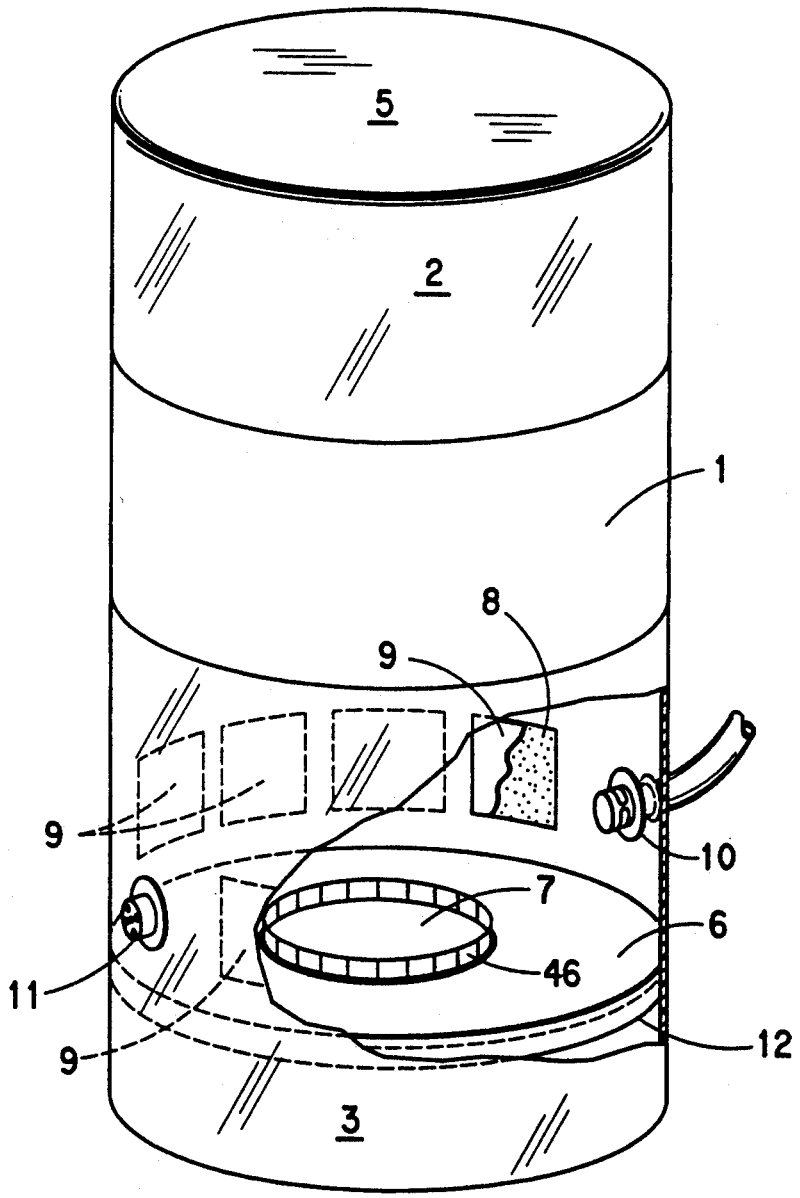
FIG. 1 is a perspective illustration of a protective hood of the present invention, partly cut away to show details of construction.

The hoods can have the tubular configuration as shown in U.S. Pat. No. 4,627,431, with a substantially circular top section attached to a tubular side section. Such a construction is shown in FIG. 1, in which generally tubular portion 1, having upper end 2 and lower end 3, has a continuous sidewall which forms the basic component of the hood. The upper end of the tubular portion is bonded to circular top portion 5. Substantially flat elastomeric annular resilient neck seal 6 is attached to the inner side portion of the lower end of the tubular portion, the neck seal having an opening 7 for admitting at least the head of the user to form a closure around the user. $CO_2$ absorption means 8 is encased in semi-permeable membrane 9 in the form of packets disposed around the interior sidewall of the tubular portion of the hood. If external air sources are intended to be used for the hood, the construction preferably further comprises inflow valve 10 and outflow valve 11.

Figure 2:
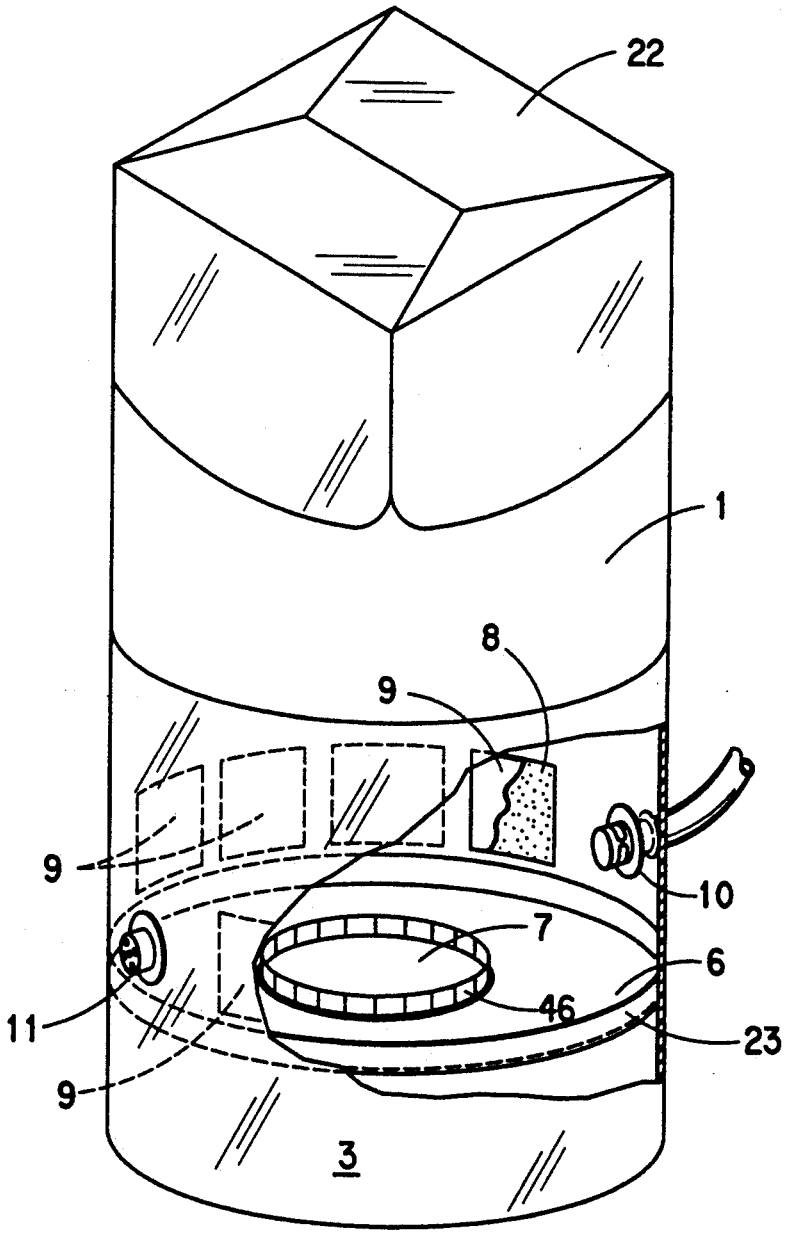
FIG. 2 is a perspective view of another embodiment of the present invention.

Alternatively, the hoods of the present invention can be constructed with a single piece of material, as shown in FIG. 2. There, the closed upper end of the hood 22 is formed by a folded configuration similar to the bottom of a paper bag. This embodiment is preferred for ease of construction.

Figure 3:
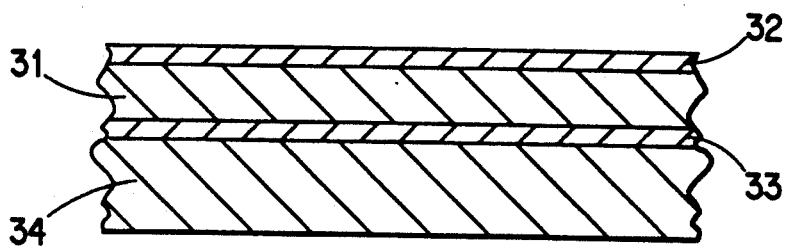
FIG. 3 is a cross-sectional view of a laminar structure which can be used in the preparation of the hoods of the present invention.

The protective hoods of the present invention can be prepared from a wide variety of materials, as disclosed in the Werjefelt patents noted above, both of which are hereby incorporated by reference. A particularly preferred material for use in the present constructions is a laminate of a core of polyimide, at least one outer layer of fluoropolymer film bonded to each surface of the polyimide core, and at least one inner layer of heat sealable polymer. The laminate can further comprise additional layers which do not adversely effect the performance of the three required layers. Such a laminate is shown in detail in FIG. 3, in which a core layer 31 of polyimide film has laminated thereto fluoropolymer layers 32 and 33 on each surface thereof. The laminar structure further comprises inner heat sealable layer 34.

The polyimide used for the core layer can be selected from those commercially available, for example, from E. I. du Pont de Nemours and Company as Kapton® polyimide film. In general, the polyimide film used in the present invention has a thickness of at least about one mil, or 0.001 inch. In general, polyimide films having a thickness of about from 0.5 to 3 mils can be used.

The polyimide core is laminated or coated on both surfaces with one or more fluoropolymer films. Fluoropolymer films provide a desirable combination of heat resistance and adherability to the polyimide core film. In addition, the provision of fluoropolymer on one or both of the surfaces of the polyimide results in a reduction of noise attributable to the crinkling of hoods prepared from polyimide alone while being worn. Possibly most importantly, the outer fluoropolymer layer protects the polyimide from the etching effects of the products of combustion, maintaining the clarity of the hood construction for visibility under the most adverse conditions.

Fluoropolymers which can be used in the present invention include, for example, polymers of tetrafluoroethylene and copolymers of tetrafluoroethylene with one or more of hexafluoropropylene, perfluoro(alkyl vinyl ether) or vinylidene fluoride. Copolymers of tetrafluoroethylene and perfluoro(alkyl vinyl ether) are designated PFA. Such polymers and copolymers are described in detail, for example, in Concannon et al., U.S. Pat. No. 4,252,859, hereby incorporated by reference.

In general, a fluoropolymer thickness of at least about 0.5 mil, and preferably about from 0.5 to 1 mil, is used on the outer surface, and preferably on each surface of the polyimide film. The thicknesses of the polyimide core and the fluoropolymer films bonded directly to the core should be adjusted so as to provide a total thickness of the trilaminate of about from 2 to 5 mils.

One particularly preferred combination for use in the hoods of the present invention is a polyimide film having a fluoropolymer film bonded on both sides which is a copolymer of tetrafluoroethylene and hexafluoropropylene, and which has a further layer on the inner surface of a copolymer of tetrafluoroethylene and poly(-propyl vinyl ether).

The fluoropolymer can be bonded to the polyimide film by any convenient means, including, for example, dispersion coating or lamination of a preformed film.

The inner layer of heat sealable polymer, and particularly FEP, provides improved ease of manufacture for the hoods. The presence of this layer obviates the need for a separate adhesive or adhesive tape that was often used for hood manufacture in the past.

The inner heat sealable polymer can be any which is melt compatible with the outer fluoropolymer. The term melt compatibility is used in its usual sense to mean that the polymers of the inner and outer films have melting points that permit the heat sealing of the two polymers. The inner layer of heat sealable material can be bonded to the other layers. However, it has been found that the bonding of this layer prior to the formation of the hood is unnecessary. In fact, the provision of any inner layer which is not tightly bonded to the adjacent layer permits the attachment of the $CO_2$ absorption packets on the interior of the hood by cutting straps in this inner layer through which the packets can be threaded. A fluoropolymer on the outside of the hood protects the outside surface from the corrosive effects of some fumes, maintaining good visibility for the wearer. A fluoropolymer layer on the inside of the hood improves tear resistance and toughness of the hood material and also tends to prevent curl of the polyimide core material during handling. Both the inner and the outer layers of fluoropolymer contribute to a sound deadening effect which results in a quieter hood for the wearer than one prepared from a single layer of polyimide film.

A portion of the outer surface of the hoods is preferably metalized, by known techniques, to provide further heat and flame protection to both the wearer and the carbon dioxide absorber.

Figure 4:
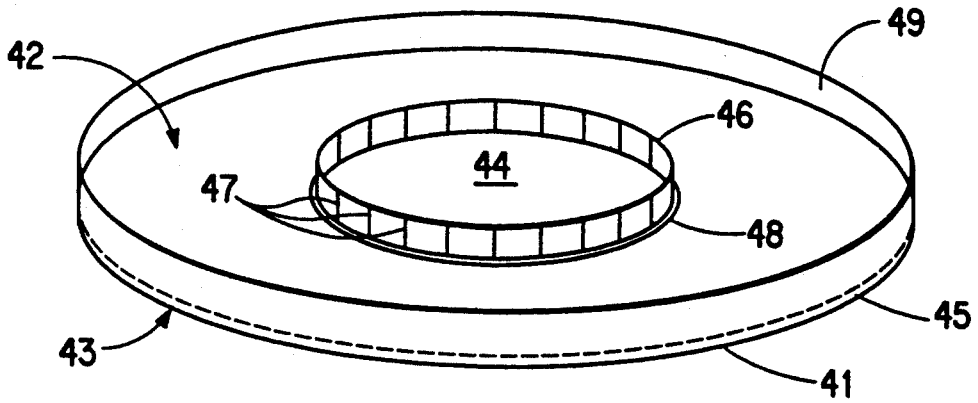
FIG. 4 is a perspective view of the neck seal of the present invention.

In accordance with the present invention, a neck seal is provided having the configuration shown in detail in FIG. 4. There, annular ring 41 having an upper surface 42 and lower surface 43 and a circular opening 44 in the center for the wearer's head is attached to the side wall of the hood at perimeter 45, generally by adhesive means. The size of the circular opening will vary, to some extent, with the thickness and elasticity of the material used. However, an opening having a diameter of about from 2¾ to 3 inches, and especially about 2⅞ inches, has been found to comfortably fit, and accordingly provide protection for, neck sizes representative of 98% of the population.

A wide variety of elastomeric materials can be used for the neck seal, as will be evident to those skilled in the art, including natural rubber or silicone rubber. Silicone rubber, has, however, been found to be particularly satisfactory, and is accordingly preferred. The thickness of the neck seal will necessarily vary with the particular elastomer used, but thicknesses of silicone rubber of about from 13 to 20 mils have been found to be satisfactory.

A preferred element of the seal is flange 46 extending in a direction perpendicular from the annular surface of the seal, and preferably upwardly from the surface. The flange should extend at least about ½ inch, and preferably about from 1 to 1½ inch from the surface of the annular ring. The flange creates a continuous seal on people with small necks by collapsing inwardly, but can still be worn comfortably by people with large necks.

The neck seal preferably further comprises reinforcing bead 48 at the base of the flange to increase tear strength of the seal. With this reinforcing bead, in the event of a tear in the flange portion, the possibility of propagation of the tear into the horizontal section of the seal is reduced.

The flange preferably has a plurality of reinforcing vertical ribs 47 around the perimeter thereof. The reinforcing ribs should be evenly distributed about the circumference of the flange, on the outer surface.

The thickness of both the reinforcing bead and the vertical ribs, when used, will vary with the thickness of the elastomer itself, and should generally provide an increase in thickness of at least about 100% and preferably about from 150 to 200%.

The neck seals can be conveniently affixed to the side walls of the hood by use of a circumferential flange, shown as element 12 in FIG. 1. In that figure, the circumferential flange extends in a downward direction and substantially perpendicular from the surface of the annular ring. In a more preferred embodiment of the present invention, the circumferential flange extends in an upward direction from the surface of the annular ring. This embodiment of the invention is shown in FIGS. 2 and 4, in which the circumferential flange is illustrated as element 23 and 49, respectively. With the positioning of the circumferential flange in the preferred upward direction, when the hood is inflated, the bond is placed in shear loading rather than the tensile loading that it would experience if the flange were positioned in a downward direction. Bonds in shear loading are stronger than bonds under tensile load.

The flange can be affixed by any convenient means, including heat sealing or an adhesive compatible with the material used for the neck seal and the side wall of the hood.

The improved neck seals of the present invention, through the provision of the vertical flange around the neck opening, are adaptable to a wider range of sizes than a simple circular opening.

The hoods of the present invention preferably comprise means for the absorption or removal of carbon dioxide, as described, for example, in U.S. Pat. No. 4,627,431. In addition, the hoods can further comprise an oxygen source. Such a self-contained oxygen source can provide further protection for a wearer after disconnection from a central air or oxygen supply. Alternatively, depending on the intended application, a self-contained oxygen source can be the primary source of breathable air, without provision for connection to a central source.

The hood constructions of the present invention combine the advantages of those previously available in the art with greater size flexibility and improved fit and comfort for the wearer, as well as improved seal performance between the interior and exterior of the hood. The central flange, which provides the seal around the neck of the wearer, results in a significant improvement over a neck seal without the flange. In operation, the flange tends to isolate the seal with the neck from movement of the annular ring. In this manner, sealing is maintained even during erratic movement of the hood in use.

The present invention is further illustrated by the following specific example.

EXAMPLE

A hood was prepared from a laminate of a 1 mil thickness of polyimide film coated on each side with a 0.5 mil thickness of a copolymer of tetrafluoroethylene and hexafluoropropylene. One side of this laminate, which was to become the inner surface of the hood, was further combined with a 2.0 mil thickness of PFA.

A sheet of the four-layer laminate was fabricated into a square-topped hood of the type illustrated in FIG. 2, with the PFA layer as the innermost surface, by heat sealing the PFA layer to itself. A silicone rubber neck seal having a thickness of 13–20 mils was prepared and adhesively attached to the bottom portion of the hood, at a position 3½ inches from the bottom edge. The neck seal had a middle hole 2⅞ inches in diameter, with a ribbed, upwardly-directed flange that extended 1 inch from the surface of the neck seal.

Packets of carbon dioxide absorbent were attached to the inner surface of the hood by threading through loops formed by making parallel slits in the PFA layer around the circumference of the hood.

A self-contained oxygen source was used as the breathable air supply.

We claim:

1. In a protective hood prepared from film having a thickness of less than about 5 mils and having a generally tubular configuration with a closed substantially flat top end and a bottom end having a resilient neck seal with an opening which permits at least the head of a user into the hood and forming a closure around the user, the improvement wherein the neck seal comprises a substantially flat elastomeric annular ring having an upper and lower surface and a circular opening in the center for the user's head and a substantially tubular central flange extending from the opening in a direction substantially perpendicular from the surface of the annular ring toward the top of the hood.

2. A protective hood of claim 1 wherein the neck seal further comprises a circumferential flange extending in a direction substantially perpendicular from the surface of the annular ring and bonded to the sidewall of the hood.

3. A protective hood of claim 2 wherein the circumferential flange extends upward from the surface of the annular ring.

4. A protective hood of claim 1 wherein the central flange on the neck seal has a plurality of reinforcing vertical ribs around the perimeter thereof.

5. A protective hood of claim 1 wherein the central flange extends upwardly from the surface of the ring at least about 1 inch.

6. A protective hood of claim 1 further comprising a bead around the edge of the central flange, at the point of its junction with the annular ring.

7. In a protective hood prepared from film having a thickness of less than about 5 mils and having a generally tubular configuration with a closed top and a bottom end having a resilient neck seal with an opening which permits at least the head of a user into the hood and forming a closure around the user, the improvement wherein the neck seal comprises a substantially flat elastomeric annular ring having an upper and lower surface and a circular opening in the center for the user's head and substantially tubular central flange extending from the opening in a direction substantially perpendicular from the surface of the annular ring toward the top of the hood and wherein the central flange on the neck seal has a plurality of reinforcing vertical ribs around the perimeter thereof.

* * * * *